United States Patent [19]

Vella et al.

[11] Patent Number: 4,634,131

[45] Date of Patent: Jan. 6, 1987

[54] GOLF PUTTING TRAINER

[76] Inventors: Claude J. Vella, 24 Westward Street, Kareela, New South Wales 2232; Raymond T. Mansell, 3 Narooma Place, Gymea, New South Wales 2227, both of Australia

[21] Appl. No.: 689,550

[22] PCT Filed: Apr. 18, 1984

[86] PCT No.: PCT/AU84/00065

§ 371 Date: Dec. 18, 1984

§ 102(e) Date: Dec. 18, 1984

[87] PCT Pub. No.: WO84/04047

PCT Pub. Date: Oct. 25, 1984

[30] Foreign Application Priority Data

Apr. 18, 1983 [AU] Australia ..... PF8923

[51] Int. Cl.[4] ..... A63B 69/36

[52] U.S. Cl. ..... 273/192; 273/183 E

[58] Field of Search ..... 273/192, 191 R, 183 E, 273/186 R

[56] References Cited

U.S. PATENT DOCUMENTS 3,473,810 10/1969 Nishikawa ..... 273/192

3,685,835 8/1972 Fahy ..... 273/192

FOREIGN PATENT DOCUMENTS 175197 2/1922 United Kingdom ..... 273/192

*Primary Examiner*—George J. Marlo

*Attorney, Agent, or Firm*—Edwin E. Greigg

[57] ABSTRACT

A device for improving golf putting and chip-shots. The device includes a guide rail supported by a support frame and allowing a shaft guide to travel therealong. The shaft of a putter club is clamped to the shaft guide so as to restrain the shaft from rotation about its longitudinal axis and to prevent axial movement of the shaft relative to the guide. However the shaft is free to pivot within the plane of the putting stroke, that is parallel to the guide rail, and to rotate in a plane transverse of the guide rail. The guide rail is selectively formable into an arcuate shape of desired radius so that the head of the golf club will subscribe a correct path when the shaft guide travels along the guide rail. The frame is attached to the base plate so as to allow relative adjustment in the fore aft direction allowing different angles to the vertical of the plane of the stroke and the different length clubs while retaining the same club head and ball position relative to the plate. The plate includes an alignment line with which a practice ball is aligned in use, and an indicator which is vertically aligned with the alignment line so that the golfer is vertically above the ball when the indicator and line coincide.

12 Claims, 9 Drawing Figures

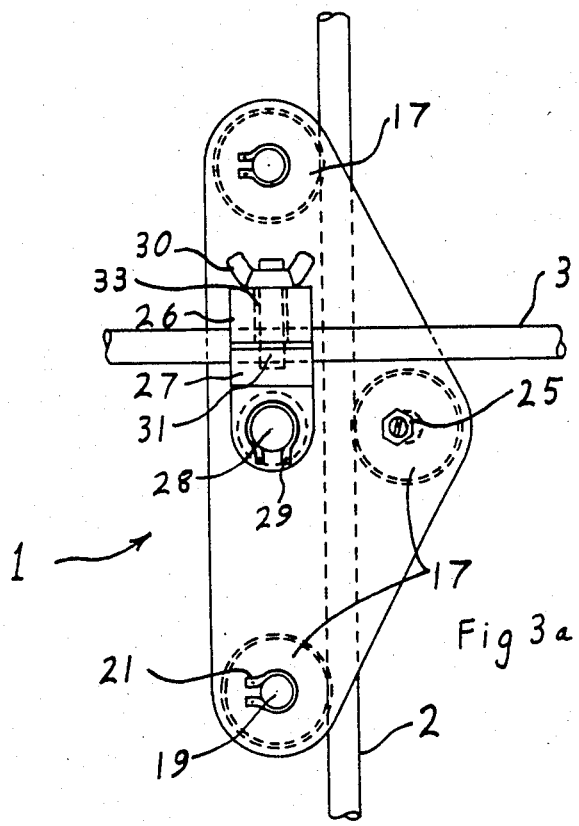
Fig 3a
Fig 3b
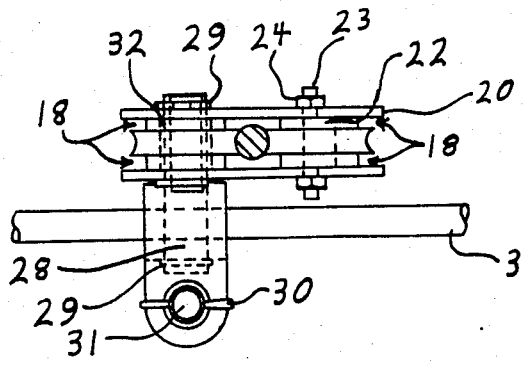

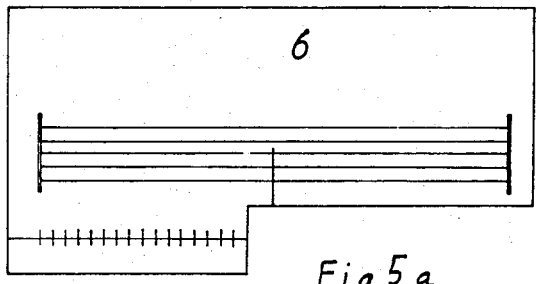
Fig 5a
Fig 5b
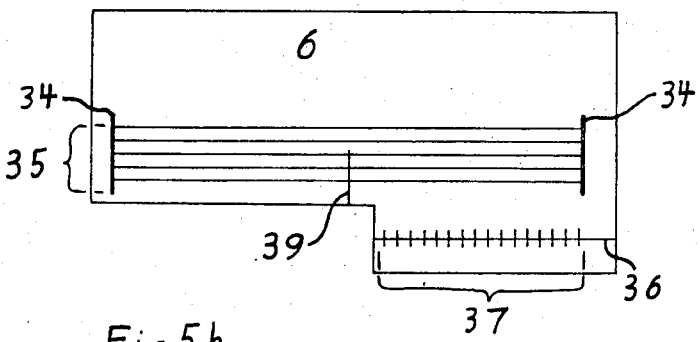
Fig 5b

GOLF PUTTING TRAINER

The present invention relates to a training device for assisting in the development of a correct putting stroke for the game of golf. The device can also be used to assist in the development of a correct chip-shot stroke where a golf ball is struck by any golf club, other than a putter, but a full swing is not used. For purposes of brevity the following description will be with reference only to putting strokes however those familiar with the game of golf will appreciate the applicability to chip-shots without any further comment.

Prior art golf training devices have been proposed where a golf club is constrained in a manner so as to follow a fixed path in which the golf club may be swung in a full arc by the training golfer. However it is recognised that the skills required during putting strokes are quite different to those of swinging the golf club for a full swing shot. The prior art training devices developed for full swing shots are therefore not useful in developing the skills required for putting shots.

It is therefore an object of the present invention to provide a golf putting trainer which will ameliorate the disadvantages of prior art by providing a device useful in developing the putting stroke.

DISCLOSURE OF THE INVENTION

Accordingly, in one broad form, the present invention may be said to consist in a golf putting trainer comprising a support structure, a guide track secured by the support structure, a guide track follower adapted to be moved along the guide track following closely the line defined thereby, and a golf club clamp device attached to the guide track follower, wherein a club attached to the club clamp is prevented from pivoting about the longitudinal axis of the club shaft, prevented from linear movement through the club clamp, and free to pivot about the axis proximate the golf track follower in planes containing said guide track and perpendicular thereto.

It is preferred that the guide track is a cylindrical sectioned, semi-rigid rod which is deformable so that it can be set in desired arcuate formations of selected radii.

Preferably the device includes a support plate with indicator marks showing correct ball position, and having the support structure attached thereto.

Preferably the training device further includes a visual guide including a line marked on the base plate and a viewing mark adjustable to be vertically above the line so that by viewing the line superimposed with the viewing mark the golfer's head is positioned vertically above the line of travel of the ball.

BRIEF DESCRIPTION OF THE DRAWINGS

By way of example only, a preferred embodiment will now be described with reference to the following drawings in which:

FIG. 3*a* is an elevation view of a portion of the device being a guide track follower; and FIG. 3*b* is a plan view of the guide track follower of FIG. 3*a;*

FIG. 5*a* is a plan view of the base plate of the device; and FIG. 5*b* is an inverted plan view of the base plate shown in FIG. 5*a*.

BEST MODE OF CARRYING OUT THE INVENTION

Figure 1:
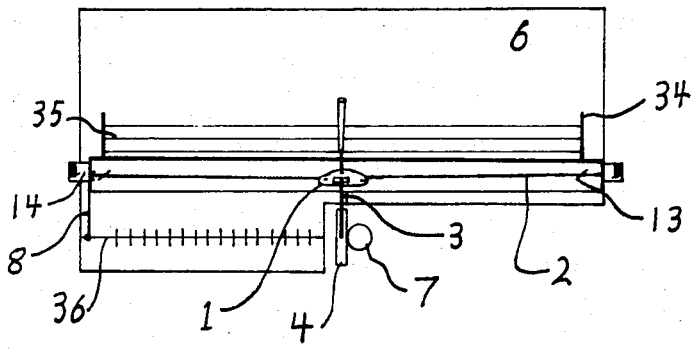
FIG. 1 is a plan view of a preferred embodiment of the invention.

The preferred embodiment of the invention described herein is shown in FIG. 1 and includes a guide rail 2, preferably of steel rod secured at its ends to a rigid frame 5. Frame 5 is attached to a base plate 6 which is adapted to be placed on flat ground in use. Base plate 6 preferably includes structure to prevent slipping of the base plate during use. This structure is not shown but might include spikes integral with the base plate 6 or small holes therethrough which nail-spikes can be inserted and driven into the ground.

A golf club is attached by its shaft 3 to shaft guide 1 which is mounted on the guide rail 2. The shaft guide 1, described in detail later herein, slides along guide rail 2 with club shaft 3 constrained to move therewith. Shaft guide 1 is rotatable relative to guide rail 2 so that shaft 3 can revolve the plane transverse of guide rail 2. Further, also explained in detail further herein, the club shaft 3 can be pivoted relative to shaft guide 1 in a plane parallel to guide rail 2. However club shaft 3 cannot be moved in the direction of the longitudinal axis of the shaft 3 relative to shaft guide 1 nor can it be rotated about that axis.

In use the golfer stands approximately at the rear edge of base plate 6 and holds the handle of the golf club, the shaft 3 of which is engaged with shaft guide 1. Depending upon the club selected and the physical size of the golfer the positioning of rigid frame 5 relative to base plate 6 is adjusted so that the head 4 of the golf club aligns with the guide line 36 of the base plate 6. Further, guide rail 2 is adjusted so as to be of an arcuate shape of selected radius so that the swing of the putter subscribes to the desired path.

Figures 2A, 2B:
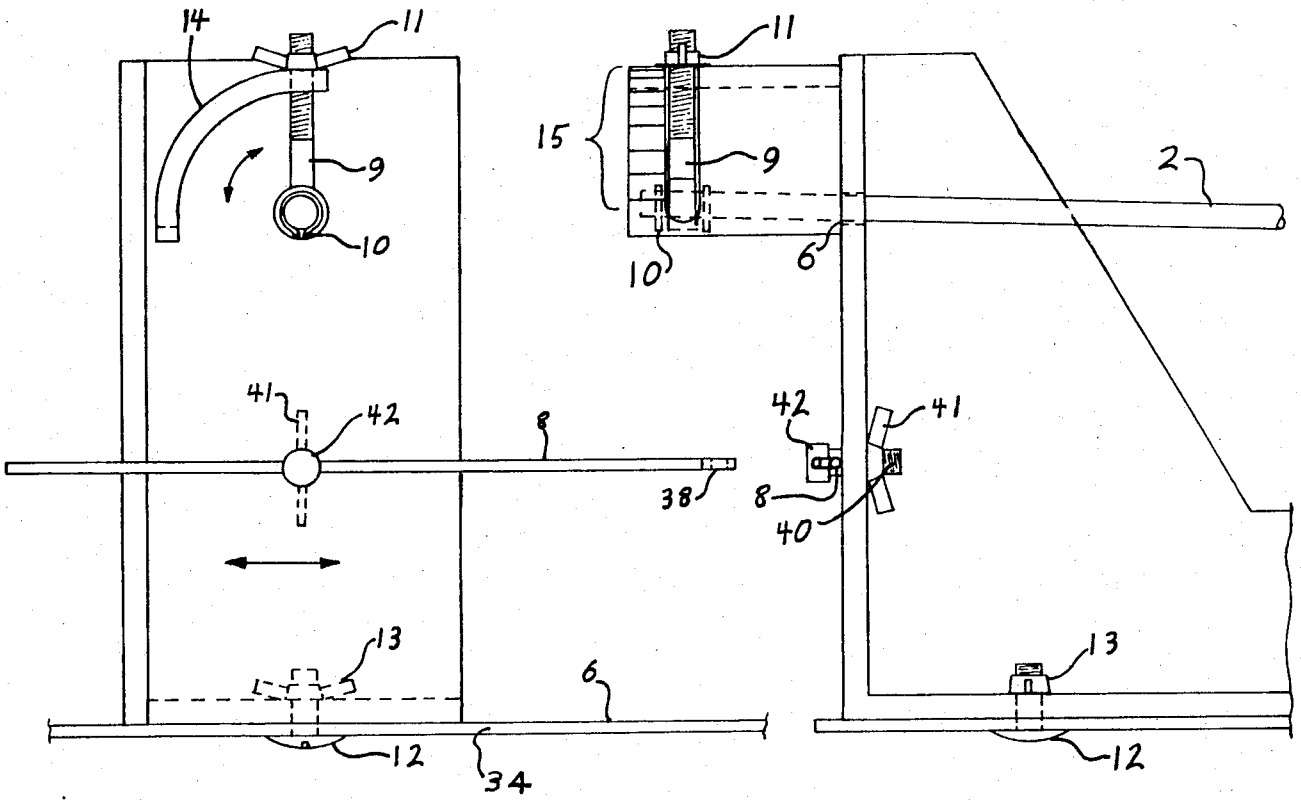
FIG. 2*a* is an elevation of a portion of the invention including an end support structure.
FIG. 2*b* is an end elevation of the portion shown in FIG. 2*a;*

As seen in FIGS. 2A and 2B guide rail 2 passes through clearance holes 6 in rigid frame 5. Each end of the guide rail 2 is connected to a link 9 which is kept in position by means of a circlip 10 connected to the guide rail 2 on each side of link 9. The link 9 has a circular loop which captures guide rail 2 therein with sufficient clearance to allow free movement of the guide rail 2 when being adjusted for the radius of arc. The adjustment of radius of arc is obtained by adjusting the tension applied by wing nut 11 to link 9 which in turn levers the end of guide rail 2 within aperture 6, at both ends of guide rail 2, so as to produce a bow in guide rail 2 between the two supports of rigid frame 5. The wing nuts 11 act against a quadrant shaped component 14 which forms part of a rigid frame 5 being attached thereto by welding. Link 9 passes through a slot in the quadrant 14 so that the link 9 and wing nut 11 may be moved to a desired position around the quadrant so that the bow obtained in guide rail 2 may be produced in a plane which is at any angle from the vertical to the horizontal. Graduations 15 are marked upon the quadrant 14 adjacent to the slot so as to allow adjustment of the inclination of the plane of the guide rail 2 and to easily ensure that the angle to the vertical of the force applied by link 9 is the same at both ends of guide rail 2.

FIGS. 3A and 3B show in detail the shaft guide 1, which is mounted to guide rail 2. The purposes of the shaft guide 1 are to constrain the movement of the putter shaft 3 with correct putting stroke path as preselected by the user, to prevent rotation of the putter shaft 3 about its own axis, to prevent axial movement of the putter shaft 3, to allow drifting movement of the putter shaft 3 within the plane of the putting stroke, to allow rotation of the putter shaft 3 about the axis of the guide rails at any point thereon.

The shaft guide 1 includes two plates 20 which may be of plastics or metal material, between which are mounted three rollers 17, preferably of nylon or similar material. The two lower rollers 17 are mounted on axles 19 between washers 18. Two circlips 21 on each axle 19 retain the plates 20, washers 18 and bottom rollers 17. The top roller 17 is mounted between two washers 18 on an axle 22 with eccentric threaded ends 23. Two nuts 24 retain the plates 20, the washers 18 and top roller 17. By moving the axle 22 in slot 25 the putter shaft 3 can be removed. When a different radius of curvature is applied to rail 2 a different setting of the eccentric ends 23 of axle 22 will be required in order to maintain the close tracking of shaft guide 1 along guide rail 2.

The putter shaft 3 is clamped between members 26 and 27 by tightening wing nut 30 which is threadedly attached to stud 31. Stud 31 is screwed to the component 27 and passes freely through hole 33 in component 26. The components 26 and 27 may be produced from plastics or metal material. Component 27 rotates about an axle 28 which extends through plates 20. A cylindrical space 32 is mounted on the axle 28 between the plates 20 with the axle 28 being retained axially by circlips 29, one at each of its ends.

In FIGS. 5A and 5B there is shown a base plate 6 which includes slots 34 therethrough and markings 35, 39, 37 and 36 on both sides of the plate 6. By this arrangement base plate 6 may be turned over so as to facilitate use by both left and right handed golfers.

Line 36 is marked on the base plate and can be used by the golfer to line up the direction of the centre of the golf ball 7 when the ball 7 is struck by the putter head 4. Graduations 37 marked right angles to the line 36 aid the user in measuring the length of the back stroke of the putter head 4, which is an indication of the distance the ball will travel after being hit.

Running perpendicular to line 36 is a marking line 39 which allows the golfer to accurately position the putter head 4 at the correct point of impact with the ball 7.

From FIGS. 2A and 2B and 5A and 5B it can be seen that rigid frame 5 is attached to support plate 6 by wing nuts 13 and screws 12. The screws 12 pass through the slots 34 of base plate 6 allowing rigid frame 5 to be slid backward and forward relative to base plate 6 so as to allow the accurate placement of the head 4 of the club, no matter what the length of the club or angle of the inclination might be. Base plate 6 includes adjustment scale 35 to ensure that the rigid frame 5 is correctly aligned with the base plate 6.

Figure 4A:
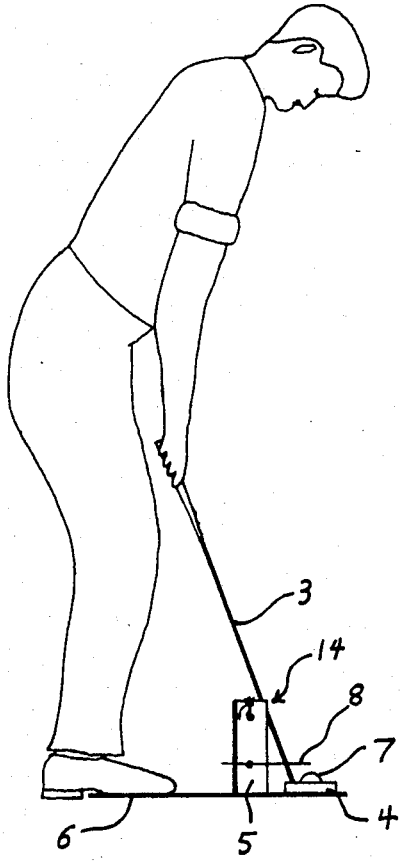
FIG. 4*a* is an end elevation of the device in use.
Figure 4B:
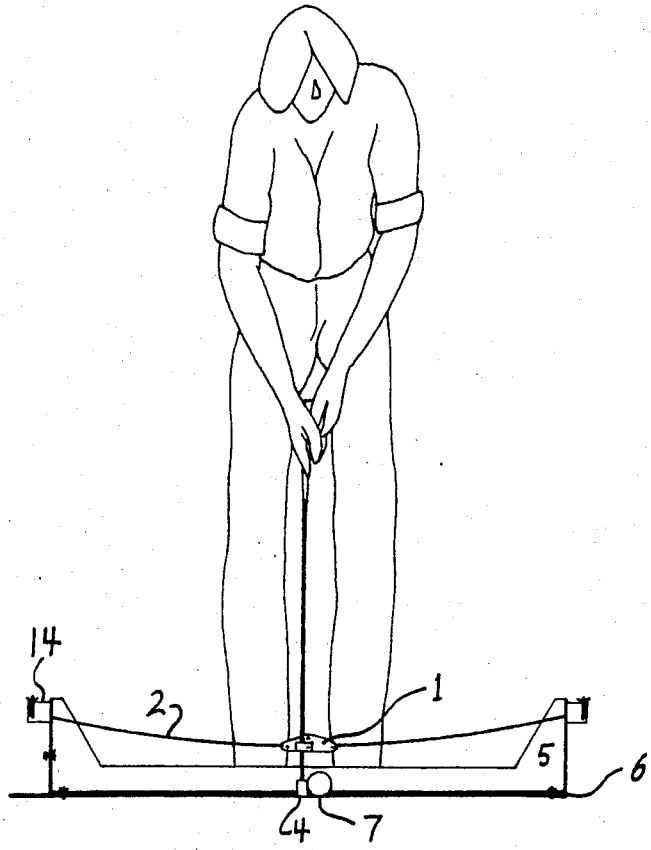
FIG. 4*b* is a front elevation of the device in use.

FIGS. 2A and 2B also show an indicator 8. The indicator 8 can be mounted on each side of frame 5 depending on whether the user is left-handed or right-handed. The indicator 8 is rod-like with an eyelet 38 in the front end thereof. The indicator 8 can be adjusted at clamp 42 and may be fixed in position by tightening wing nut 41 which is on screw 40. The indicator 8 is adjusted by the user so that the centre of the eyelet 38 is perpendicular above line 36 of the base plate. When the user is practising putting, as seen in FIGS. 4A and 4B he sights line 36 through the eyelet 38 thus ensuring that his eyes are vertically above the line of the putting stroke when applied to the centre line of the golf ball 7. When a different length club, or different inclination is to be used and rigid frame 5 has to be relocated on base plate 6 the guide arm 8 also requires relocation.

We claim:

1. A golf putting trainer device comprising: a support structure with oppositely disposed upright members; an arcuate guide track supported at approximate ends thereof by respective said upright members; a guide track follower attached to said guide track for translation therealong and rotation about the longitudinal axis thereof; adjustable deflection means at each end of said guide track, each deflection means including an adjustable forcing device proximate a respective said upright member and applying a force transversely on said guide track so as to form with the upright member a couple acting on the respective end of the guide track thereby bending said guide track into an arcuate shape of adjustable curvature; and a club clamp secured to said guide track follower for rotation about an axis perpendicular to the longitudinal axis of said guide track, wherein a golf club attached to said club clamp is free to revolve about said axis proximate to said guide track follower for movement in planes parallel with said guide track and transverse thereto.

2. The device of claim 1 further comprising a base plate adjustably fixed to said support structure for selective orientation therewith.

3. The device as defined in claim 1 wherein said deflection means include, at each end of said guide track, an aperture in said support structure with said guide track passing therethrough, and a threadedly tensioned member spaced from said support structure for applying transverse deflective tension to said guide track.

4. A device as defined in claim 1 wherein said guide track follower includes two parallel spaced apart plates with three roller devices therebetween, said roller devices spaced two on one side of said guide track and one on the other side of said guide track, at least one roller device being axially moveable toward and away from said guide track so as to adjust free-play between said rollers and said guide track.

5. A device as defined in claim 1 including an eye guide comprising a fixed datum line aligned with the position for placing the golfball, and a vertically distance datum point adapted to be placed vertically above the line so that when said datum point and said datum line are visually aligned the user's eye is vertically above the line of the ball.

6. A device as defined in claim 1 wherein an angle of inclination of a plane defined by movement of said arcuate guide track is adjustable.

7. A device as defined in claim 6 wherein the angle of inclination is adjusted by adjusting the angle at which force is applied by said deflection means to said guide track.

8. A golf putting trainer device comprising a support structure affixed to a base plate, said support structure having oppositely disposed upright members, each of said upright members being provided with aligned apertures, a rod element positioned in each of said apertures in said upright members, adjustable means positioned proximate to each of said upright members arranged to apply a transverse torque to said rod element, golf club shaft engaging means arranged to slide along said rod element and said golf club shaft engaging means further includes means to lock said golf club shaft against slippage in a longitudinal direction.

9. A golf putting trainer device as claimed in claim 8, in which said golf club shaft can be pivoted relative to said shaft engaging means in a plane parallel to said rod element.

10. A golf putting trainer device as claimed in claim 8, in which each of said upright members is arranged to be adjusted to and fro relative to said base plate.

11. A golf putting trainer device as claimed in claim 8, in which said base plate further includes an alignment means bearing indicia, an elevated indicator means adjustably supportable proximate to either of said upright members, means for locating said alignment means at either end of said base plate for use by either a left handed or a right handed golfer, said elevated indicator means permitting a golfer to sight downwardly on said alignment means whereby a golfer may be maintained vertically above a golf ball in a proper putting relationship therewith.

12. A golf putting trainer device as claimed in claim 8, in which said golf club shaft engaging means further includes two parallel spacedly arranged plates having three roller devices positioned therebetween a pair of said roller devices arranged to engage a portion of said rod element and another of said roller devices arranged to engage an opposed portion of said rod element, at least one of said roller devices being adjustable relative to said parallel spacedly arranged plates.

* * * * *